US008309285B2

(12) United States Patent
Heuft et al.

(10) Patent No.: US 8,309,285 B2
(45) Date of Patent: Nov. 13, 2012

(54) PROTECTIVE OVERCOAT LAYER AND PHOTORECEPTOR INCLUDING SAME

(75) Inventors: Matthew A. Heuft, Oakville (CA); Hany Aziz, Oakville (CA); Kathy L. De Jong, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 965 days.

(21) Appl. No.: 11/936,523

(22) Filed: Nov. 7, 2007

(65) Prior Publication Data

US 2009/0117476 A1 May 7, 2009

(51) Int. Cl.
*G03G 15/04* (2006.01)

(52) U.S. Cl. ..... 430/58.65; 430/66

(58) Field of Classification Search ..... 430/48, 430/58.65, 66

See application file for complete search history.

(56) References Cited

U.S. PATENT DOCUMENTS

| | | | | |
|---|---|---|---|---|
| 3,121,006 | A | 2/1964 | Middleton et al. | |
| 4,457,994 | A | 7/1984 | Pai et al. | |
| 4,871,634 | A | 10/1989 | Limburg et al. | |
| 5,702,854 | A | 12/1997 | Schank et al. | |
| 5,976,744 | A | 11/1999 | Fuller et al. | |
| 6,010,810 | A * | 1/2000 | Uesaka et al. | 430/58.8 |
| 7,648,810 | B2 * | 1/2010 | Yanus et al. | 430/59.6 |
| 2007/0072101 | A1 * | 3/2007 | Dinh et al. | 430/66 |
| 2007/0166634 | A1 * | 7/2007 | Qi et al. | 430/58.7 |

OTHER PUBLICATIONS

U.S. Appl. No. 11/234,275, filed Sep. 26, 2005.
U.S. Appl. No. 11/295,134, filed Dec. 13, 2005.
U.S. Appl. No. 10/992,913, filed Nov. 18, 2004.

* cited by examiner

*Primary Examiner* — Thorl Chea
(74) *Attorney, Agent, or Firm* — Oliff & Berridge, PLC

(57) ABSTRACT

Disclosed is an electrophotographic imaging member that includes a substrate; a charge generating layer; a charge transport layer; and a protective overcoat layer having a polyol binder; a hole transport material; an acid catalyst; a leveling agent; and no melamine formaldehyde curing agent or cross-linking additive. Also disclosed is a process for forming a photoreceptor that includes providing a substrate; applying to it a charge generating layer, charge transport layer; and protective over coating layer having a polyol binder; a hole transport material; an acid catalyst; a leveling agent; and no melamine formaldehyde curing agent or cross-linking additive. Additionally provided is a method of forming an image with the disclosed electrophotographic imaging member.

8 Claims, 3 Drawing Sheets

PROTECTIVE OVERCOAT LAYER AND PHOTORECEPTOR INCLUDING SAME

TECHNICAL FIELD

This disclosure is generally directed to electrophotographic imaging members and more specifically, to layered photoreceptor structures comprising a protective overcoat layer containing no melamine formaldehyde and having a polyol binder and a hole transport material comprising two or more hydroxymethyl substituents that are capable of crosslinking with the polyol binder. This disclosure also relates to processes for making and using the imaging members.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating.

U.S. patent application Ser. No. 11/234,275 filed Sep. 26, 2005, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

U.S. patent application Ser. No. 11/295,134 filed Dec. 13, 2005, discloses an electrophotographic imaging member comprising a substrate, a charge generating layer, a charge transport layer, and an overcoating layer, said overcoating layer comprising terphenyl arylamine dissolved or molecularly dispersed in a polymer binder.

U.S. patent application Ser. No. 10/992,913 filed Nov. 18, 2004, discloses a process for preparing an overcoat for an imaging member, said imaging member comprising a substrate, a charge transport layer, and an overcoat positioned on said charge transport layer, wherein said process comprises: a) adding and reacting a prepolymer comprising a reactive group selected from the group consisting of hydroxyl, carboxylic acid and amide groups, a melamine formaldehyde crosslinking agent, an acid catalyst, and an alcohol-soluble small molecule to form an overcoat solution; and b) subsequently providing said overcoat solution onto said charge transport layer to form an overcoat layer.

Phenolic overcoat compositions comprising a phenolic resin and a triarylamine hole transport molecule are known. These phenolic overcoat compositions can be cured to form a crosslinked structure.

Disclosed in U.S. Pat. No. 4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, are desirably be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer.

Providing a protective overcoat layer is a conventional means of extending the useful life of photoreceptors. Conventionally, for example, a polymeric overcoat has been utilized as a robust overcoat design for extending the lifespan of photoreceptors. The conventional polymeric overcoat includes (i) a polyol binder, (ii) a melamine-formaldehyde curing agent; (iii) a hole transport material; (iv) an acid catalyst; and (v) a leveling agent coated from an alcoholic solution. However, the conventional overcoat formulation generates unacceptably high levels of free formaldehyde remaining after curing, which poses a human health hazard. The free formaldehyde arises from the melamine cross-linking component of the overcoat formulation.

Despite the various approaches that have been taken for forming imaging members there remains a need for improved imaging member design, to provide improved imaging performance and longer lifetime, reduce human and environmental health risks, and the like.

SUMMARY

This disclosure addresses some or all of the above described problems and also provides materials and methods for improved imaging performance, longer lifetime, and the like of electrophotographic photoreceptors. This is generally accomplished by using a protective overcoat layer containing no melamine formaldehyde and having a hole transport material comprising two or more hydroxymethyl substituents that are capable of cross-linking with a polyol binder. This disclosure also relates to processes for making and using the imaging members.

This disclosure thus describes a novel protective overcoat composition that does not require a melamine-formaldehyde crosslinking additive, which will significantly reduce or eliminate free formaldehyde levels during solution preparation and in the finished overcoat. This improved formulation is comprised of (i) a polyol binder; (ii) a hole transport material containing functional groups to cross-link the binder; (iii) an acid catalyst; and, optionally (iv) a leveling agent coated from a suitable solvent system. The use of certain hole transport materials in photoreceptor overcoat formulations can be modified to contain chemically reactive groups to facilitate crosslinking with an appropriate binder, which eliminates the need for the melamine-formaldehyde cross-linking agent.

In an embodiment, the present disclosure provides a cured coating composition comprising at least a polyol binder and a charge transport material capable of reacting with the polyol binder, the charge transport material being represented by the following general formula

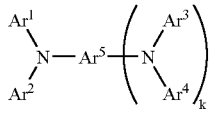

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$ and $Ar^4$ comprises a hydroxymethyl group or an alkoxymethyl group having from 1 to about 6 carbon atoms.

In another embodiment, the present disclosure provides a photoreceptor comprising:

a substrate;

a charge generating layer optionally combined with or separate from a charge transport layer; and a protective overcoat layer;

wherein any of the substrate, charge generating layer, charge transport layer, or protective overcoat layer comprises a cured coating composition comprising at least a polyol binder and a charge transport material capable of reacting with the polyol binder, the charge transport material being represented by the following general formula

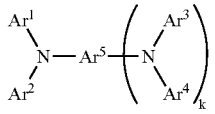

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$ and $Ar^4$ comprises a hydroxymethyl group or an alkoxymethyl group having from 1 to about 6 carbon atoms.

In another embodiment, the present disclosure provides a method of forming an image, comprising:

applying a charge to a photoreceptor;

exposing the photoreceptor to electromagnetic radiation;

developing a latent image formed by exposing the photoreceptor to the electromagnetic radiation to form a visible image; and transferring the visible image to a print substrate;

wherein the applying includes applying to at least one layer a cured coating composition comprising at least a polyol binder and a charge transport material capable of reacting with the polyol binder, the charge transport material being represented by the following general formula

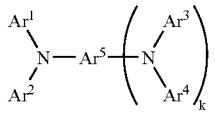

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$ and $Ar^4$ comprises a hydroxymethyl group or an alkoxymethyl group having from 1 to about 6 carbon atoms.

The present disclosure also provides electrophotographic image development devices comprising such electrophotographic imaging members. Also provided are imaging processes using such electrophotographic imaging members.

EMBODIMENTS

Figure 1:
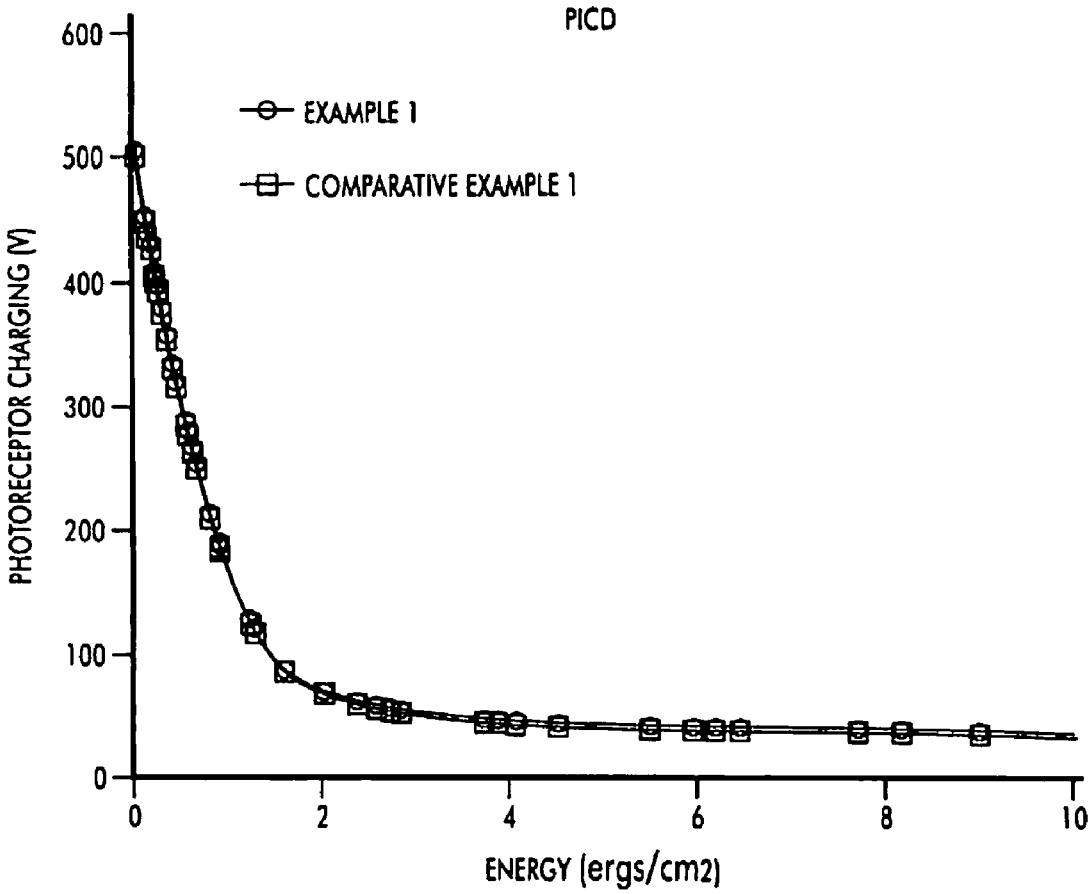
FIG. 1 is a graph of PIDC (Photo-Induced Discharge Curve) curves for photoreceptors of the Examples and Comparative Examples of the disclosure.

The present disclosure relates generally to photoconductive imaging members such as photoconductors, photoreceptors and the like, for example that may be used in electrophotographic or xerographic imaging processes. The photoconductive imaging members have an overcoat layer that achieves adhesion to the charge transport layer and comprises no melamine formaldehyde, thus generating reduced or no free formaldehyde.

The photoconductive imaging members are, in embodiments, multilayered photoreceptors that comprise a substrate, an optional conductive layer, an optional undercoat layer, an optional adhesive layer, a charge generating layer, a charge transport layer, and a protective overcoat layer. The protective overcoat layer may comprise the cross linked product of at least a hole transport material comprising two or more hydroxymethyl substituents that are capable of cross-linking with a polyol binder and no melamine formaldehyde as a cross-linking agent or curing agent.

There are many additional hole transport materials that can be modified to contain chemically reactive groups to facilitate cross linking with an appropriate binder. The use of these compounds in the photoreceptor overcoat formulations eliminates the need for a cross linking agent.

This disclosure thus describes a novel protective overcoat composition that does not require a melamine-formaldehyde crosslinking additive, which will significantly reduce or eliminate the generation of free formaldehyde during solution preparation and in the finished overcoat. This formulation may further comprise a (i) a polyol binder; (ii) a hole transport material containing functional groups to cross-link the binder; (iii) an acid catalyst; and, optionally (iv) a leveling agent coated from a suitable solvent system.

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Illustrative examples of substrates are as illustrated herein, and more specifically layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®, a polycarbonate resin having a weight average molecular weight of from about 50,000 to about 100,000, commercially available from Farbenfabriken Bayer A. G., or similar resin.

The thickness of the photoconductor substrate layer depends on many factors, including economical considerations, electrical characteristics, number of layers, components in each of the layers, and the like, thus this layer may be of substantial thickness, for example over about 3,000 microns, and more specifically the thickness of this layer can be from about 1,000 to about 3,000 microns, from about 100 to about 1,000 microns or from about 300 to about 700 microns, or of a minimum thickness. In embodiments, the thickness of this layer is from about 75 microns to about 300 microns, or from about 100 to about 150 microns.

A charge blocking layer or hole blocking layer may optionally be applied to the electrically conductive surface prior to the application of a photogenerating layer. When desired, an adhesive layer may be included between the charge blocking layer, the hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4-isopropylidenediphenol), E (4,4'-ethylidenebisphenol), F (bis(4-hydroxyphenyl)methane), M (4,4'-(1,3-phenylenediisopropylidene) bisphenol), P (4,4'(1,4-diisopropylidene)bisphenol), S (4,4'-sulfonyldiphenol), and Z (4,4'cyclohexylidenebisphenol); hexafluorobisphenol A (4,4'-(hexafluoro isopropylidene) diphenol), resorcinol, hydroxyquinone, catechin, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The photogenerating layer in embodiments is comprised of, for example, about 60 weight percent of Type V hydroxygallium phthalocyanine or chlorogallium phthalocyanine, and about 40 weight percent of a resin binder like poly (vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques; and a number of phthalocyanines, like a titanyl phthalocyanine, titanyl phthalocyanine Type V; oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine and the like with infrared sensitivity photoreceptors exposed to low-cost semiconductor laser diode light exposure devices.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, photogenerating layer of a thickness, for example, of from about 0.1 to about 30, or from about 0.5 to about 2 microns can be applied to or deposited on the substrate, on other surfaces in between the substrate and the charge transport layer, and the like. The photogenerating composition or pigment is present in the resinous binder composition in various amounts. From about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 10 percent by volume of the photogenerating pigment is dispersed in about 90 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air-drying and the like.

In embodiments, at least one charge transport layer is comprised of at least one hole transport component of the above-mentioned formulas/structures. The concentration of the hole transport component may be low to, for example, achieve increased mechanical strength and LCM resistance in the photoconductor. In embodiments the concentration of the hole transport component in the charge transport layer may be from about 10 weight percent to about 65 weight percent and more specifically from about 35 to about 60 weight percent, or from about 45 to about 55 weight percent. The hole transport component may have a purity of from about 90 percent to about 100 percent, such as from about 98 percent to about 100 percent, and from about 35 weight percent to about 70 weight percent of MAKROLON 5705®, a known polycarbonate resin having a molecular weight average of from about 50,000 to about 100,000, commercially available from Farbenfabriken Bayer A. G.

The charge transport layer, such layer being generally of a thickness of from about 5 microns to about 90 microns, and more specifically, of a thickness of from about 10 microns to about 40 microns, may include a number of hole transport compounds, such as substituted aryl diamines and known hole transport molecules, as illustrated herein, and additional components, including additives, such as antioxidants, a number of polymer binders and the like. In embodiments, additives may include at least one additional binder polymer, such as from 1 to about 5 polymers in a percent weight range of about 10 to about 75 in the charge transport layer; at least one additional hole transport molecule, such as from 1 to about 7, 1 to about 4, or from 1 to about 2 in a percent weight range of about 10 to about 75 in the charge transport layer; antioxidants; like IRGONAX (available from Ciba Specialty Chemical), in a percent weight range of about 0 to about 20, from about 1 to about 10, or from about 3 to about 8 weight percent.

The charge transport layer may comprise hole transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to hole transporting molecules dispersed in the polymer, the small molecules being dispersed in the polymer on a molecular scale. Various hole transporting or electrically active small molecules may be selected for the charge transport layer. In embodiments, hole transport refers, for example, to hole transporting molecules as a monomer that allows the free charge generated in the photogenerating layer to be transported across the transport layer.

Examples of added hole transporting molecules include, for example, pyrazolines such as 1-phenyl-3-(4'-diethylamino styryl)-5-(4"-diethylamino phenyl)pyrazoline; aryl amines such as N,N'-diphenyl-N N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1.1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the hole transport material in the charge transport layer may comprise a polymeric hole transport material or a combination of a small molecule hole transport material and a polymeric hole transport material.

Specific examples of a hole transport molecule encompassed herein may further include a tetra[p-tolyl] biphenyldiamine also referred to as N,N,N'N'-tetra(4-methylphenyl)-(1,1'-biphenyl)-4,4'-diamine; N,N,N'N'-tetra(4-ethylphenyl)-(1,1'-biphenyl)-4,4'-diamine; N,N,N'N'-tetra (4-propylphenyl)-(1, 1'-biphenyl)-4,4'-diamine; N,N,N'N'-tetra(4-butylphenyl)-(1,1'-biphenyl)-4,4'-diamine and the like.

Examples of the binder materials selected for the charge transport layer include components, such as those described in U.S. Pat. No. 3,121,006, the entire disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl) carbonate (also referred to as bisphenol—C-polycarbonate), and the like. In embodiments, electrically inactive binders are comprised of polycarbonate resins with a molecular weight of from about 20,000 to about 100,000, such as a molecular weight $M_w$ of from about 50,000 to about 100,000. Generally, the transport layer contains from about 10 to about 75 percent by weight of the hole transport material, and more specifically, from about 35 percent to about 50 percent of this material.

The thickness of the charge transport layer in embodiments is from about 5 to about 90 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

A number of processes may be used to mix and thereafter apply the charge transport layer coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

An overcoat layer is formed over the charge transport layer. This protective overcoat layer may increase the extrinsic life of a photoreceptor device and may maintain good printing quality or deletion resistance when used in an image forming apparatus.

In embodiments, a protective overcoat layer is provided that does not incorporate, completely or substantially (such as includes at most only trace but ineffective amounts of) a melamine-formaldehyde cross linking additive. This improved formulation is comprised of (i) a polyol binder, (ii) a hole transport material comprising two or more hydroxymethyl substituents that are capable of cross-linking with the polyol binder; (iii) an acid catalyst, and, optionally (iv) a leveling agent coated from a suitable solvent system.

Different classes of binders that contain pendent functional groups capable of crosslinking could be used. For example, functionalized polycarbonates, polyesters, and polyacrylates could be suitable binders. Commercially available binders that meet these characteristics include the hydroxyalkyl functioned polyester Desmophen 800, available from Bayer, and the hydroxyalkyl functionalized polyacrylate Joncryl 587, available from BASF. Other specific suitable polymer binders may include, but are not limited to, polypropylene glycols (such as, for example, PPG 2000), acrylic polyols (such as, for example, B-60 from OPC Polymers, Joncryl 510 or Joncryl 517 from Johnson Polymers), and the like.

The binder for the overcoat layer may include one or more of thermoplastic and thermosetting resins such as polyamide, polyurethane, polyvinyl acetate, polyvinyl butyral, polysiloxane, polyacrylate, polyvinyl acetal, phenylene oxide resins, terephthalic acid resins, phenoxy resin, epoxy resin, acrylonitrile copolymer, cellulosic film former, poly(amideimide) and the like. These polymers may block, random or alternating copolymers. The polymer binder such as polyvinylbutyral (PVB) may provide a desired rheology for coating, and may improve the coating quality of the overcoat film.

In embodiments, the binder may be a polyester polyol, such as a highly branched polyester polyol. By "highly branched" is meant a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. As used herein, "polyester polyol" is meant to encompass such compounds that include multiple ester groups as well as multiple alcohol (hydroxyl) groups in the molecule, and which can include other groups such as, for example, ether groups and the like. In embodiments, the polyester polyol can thus include ether groups, or can be free of ether groups.

It has been found that such polyester polyols provide improved results when incorporated as a binder in the overcoating layer, particularly when combined with the hole transporting molecule. Specifically, the polyester polyols provide hard binder layers, but which layers remain flexible and are not prone to crack formation.

Examples of such suitable polyester polyols include, for example, polyester polyols formed from the reaction of a polycarboxylic acid such as a dicarboxylic acid or a tricarboxylic acid (including acid anhydrides) with a polyol such as a diol or a triol. In embodiments, the number of ester and alcohol groups, and the relative amount and type of polyacid and polyol, can be selected such that the resulting polyester polyol compound retains a number of free hydroxyl groups, which can be used for subsequent crosslinking of the material in forming the overcoating layer binder material. For example, suitable polycarboxylic acids include, but are not limited to, adipic acid ($COOH[CH_2]_4COOH$), pimelic acid ($COOH[CH_2]_5COOH$), suberic acid ($COOH[CH_{12}]_6COOH$), azelaic acid ($COOH[CH_2]_7COOH$), sebasic acid ($COOH[CH_2]_8COOH$), and the like. Suitable polyols include, but are not limited to, difunctional materials such as glycols or trifunctional alcohols such as triols and the like, including propanediols ($HO[CH_2]_3OH$), butanediols ($HO[CH_2]_4OH$), hexanediols ($HO[CH_2]_6OH$), glycerine ($HOCH_2CHOHCH_2OH$), 1,2,6-Hexane triol ($HOCH_2CHOH[CH_2]_4OH$), and the like.

In embodiments, the suitable polyester polyols are reaction products of polycarboxylic acids and polyols and can be represented by the following formula (1):

$$[CH_2R_aCH_2]_m[CO_2R_bCO_2]_n[CH_2R_cCH_2]_p[CO_2R_dCO_2]_q \quad (1)$$

where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

Specific commercially available examples of such suitable polyester polyols include, for example: the DESMOPHEN® series of products available from Bayer Chemical, including the DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036 products; the SOVERMOL® series of products available from Cognis, including the SOVERMOL® 750, 805, 815, 908, 910, and 913 products: and the HYDAGEN® series of products available from Cognis, including the HYDAGEN® HSP product; and mixtures thereof. In embodiments, for example, are DESMOPHEN® 800 and SOVERMOL® 750, or mixtures thereof. DESMOPHEN® 800 is a highly branched polyester bearing hydroxyl groups, having an acid value of .Itoreq.4 mg KOH/g, a hydroxyl content of about 8.6.+−.0.3%, and an equivalent weight of about 200. DESMOPHEN® 800 corresponds to the above formula (I) where the polymer contains 50 parts adipic acid. 10 parts phthalic anhydride, and 40 parts 1,2,6-hexanetriol, where $Rb=[CH_2]_4$, n=0.5, $Rd=-1,2—C_6H_4$, q=0.1, $Ra=Rc=CH_2[CHO][CH_2]_4$, and m+p=0.4. DESMOPHEN® 1100 corresponds to the above formula (I) where the polymer contains 60 parts adipic acid, 40 parts 1,2,6-hexanetriol, and 60 parts 1,4-butanediol, where $Rb=Rd=[CH_2]_4$, n+q=0.375, $Ra=CH_2[CHO][CH_2]_4$, m=0.25, $R_c=[CH_2]_4$, and p=0.375. SOVERMOL® 750 is a branched polyether/polyester/polyol having an acid value of less than or equal to 2 mg KOH/g, and a hydroxyl value of 300-330 mg KOH/g.

Examples of the polyol used for obtaining a crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentaneglycol, 1,6-hexaneglycol, 1,4-cyclohexanediol, 1,4-cyclohexanedimethanol, dipropylene glycol, polyethylene glycol, polypropylene glycol, polytetramethylene glycol, bisphenol A, bisphenol Z and hydrogenated bisphenol A.

Polyhydric alcohols used for obtaining an amorphous polyester may be, for example, an aliphatic, alicyclic or aromatic alcohol, and examples thereof include, but are not limited to, 1,5-pentanediol, 1,6-hexanediol, 1,4-cyclohexanediol, 1,4-cyclohexane-dimethanol, dipropylene glycol, polyethylene glycol, polypropylene glycol, polytetramethylene glycol, bisphenol A, bisphenol Z and hydrogenated bisphenol A.

Further polyols usable in the present disclosure are compounds having no addition-polymerizable unsaturated group and having two or more hydroxyl groups within one molecule. Out of these compounds, the diol is a compound having two hydroxyl groups within one molecule, and examples thereof include ethylene glycol, propylene glycol, butanediol, diethylene glycol, hexanediol, cyclohexanediol, octanediol, decanediol and dodecanediol. Examples of the polyol other than the diol include glycerin, pentaerythritol, hexamethylolmelamine, hexaethylolmelamine, tetramethylolbenzoguanamine and tetraethylolbenzoguanamine. One of these polyhydric alcohols may be used alone, or two or more thereof may be used in combination.

In other embodiments, the binder can include an acrylated polyol. Suitable acrylated polyols can be, for example, the reaction products of propylene oxide modified with ethylene oxide, glycols, triglycerol and the like.

In embodiments, the overcoat layer may be comprised of from about 10 wt. % to about 75 wt. % polymer binders, such as from about 50 wt. % to about 75 wt. % polymer binders, of the overcoat layer.

Many hole transport materials are available or can be modified to contain chemically reactive groups that facilitate cross linking with an appropriate binder. The use of these compounds in the photoreceptor overcoat formulations eliminates the need for a cross linking agent, such as melamine formaldehyde, which will significantly reduce or eliminate free formaldehyde levels during solution preparation and in the finished overcoat.

Hole transport materials containing two or more hydroxymethyl substituents that can cross link with a polyol binder are suitable hole transport materials, in embodiments. For example, in embodiments, the hole transport materials containing two, three, or four hydroxymethyl substituents that can crosslink with the polyol binder. Of course, hole transport materials containing more hydroxymethyl substituents that can crosslink with the polyol binder, or other substituents that can crosslink with the polyol binder, can be used. Other crosslinking HTM substituents include but are not limited to alkyl arylmethyl ethers, epoxides, and isocyanates.

The Hole transport material may be represented by the following general

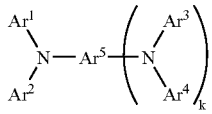

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$ and $Ar^4$ comprises a hydroxymethyl group or an alkoxymethyl group having from 1 to about 6 carbon atoms.

Additional representative hole transport materials are shown below.

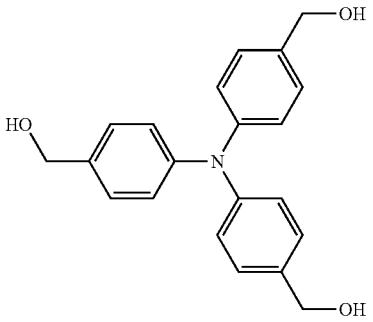

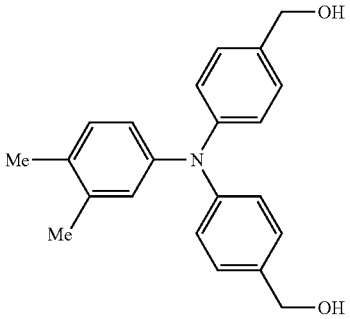

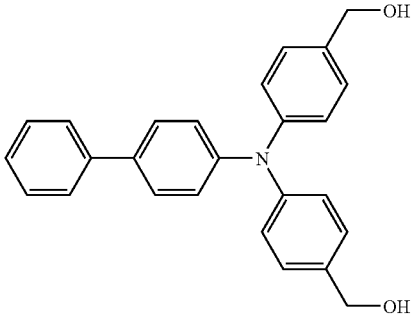

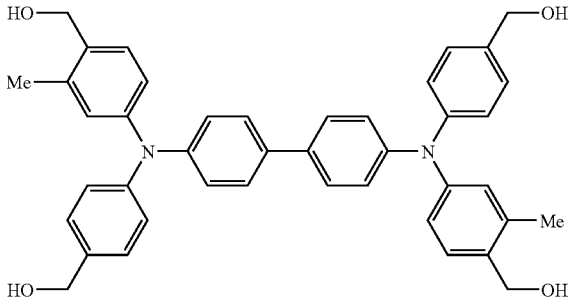

-continued

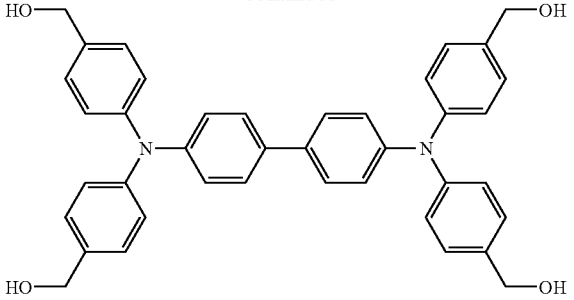

In embodiments, the overcoat layer is may be comprised of from about 25 wt. % to about 90 wt. % hole transport molecule, for example from about 25 wt. % to about 50 wt. % of the overcoat layer.

Crosslinking is generally accomplished by heating in the presence of a catalyst. Thus, the solution of the polyester polyol can also include a suitable catalyst. Any suitable catalyst may be employed. Typical catalysts include, for example, oxalic acid, maleic acid, carbollylic acid, ascorbic acid, malonic acid, succinic acid, tartaric acid, citric acid, toluenesulfonic acid, methanesulfonic acid, benzenesulfonic acid, naphthalenesulfonic acid, hydrochloric acid, sulfuric acid, nitric acid, acetic acid, trifluoroacetic acid, formic acid, glycolic acid, glyoxylic acid, poly(acrylic acid), poly(vinyl chloride-co-vinyl acetate-co-maleic acid), mixtures thereof, derivatives thereof and the like. Organic acid catalysts such as acetic acid, trifluoroacetic acid, oxalic acid, formic acid, glycolic acid, glyoxylic acid, toluenesulfonic acid, mixtures thereof and derivatives thereof, and the like, may be desirably used. Derivates of the catalyst refers to, for example, salts thereof, for example salts with an organic base, such as pyridine, piperidine, and the like. Commercially available catalyst, such as CYCAT 4040 from Cytec Industries Inc. and NACURE 5225 from King Industries may be selected.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking may be useful for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as polyester polyol/acrylated polyol, catalyst, temperature and time used for the reaction. In embodiments, the polyester polyol/acrylated polyol is cross linked at a temperature between about 100° C. and about 150° C. A typical cross linking temperature used for polyester polyols/acrylated polyols with p-toluenesulfonic acid as a catalyst is less than about 140° C. for about 40 minutes. A typical concentration of acid catalyst is between about 0.01 and about 5.0 weight percent based on the weight of polyester polyol/acrylated polyol. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the transport molecule in the crosslinked polymer network.

Crosslinking reactions between the charge transport molecule and the polyol binder include, for example, the formation of two or more ether linkages as illustrated below:

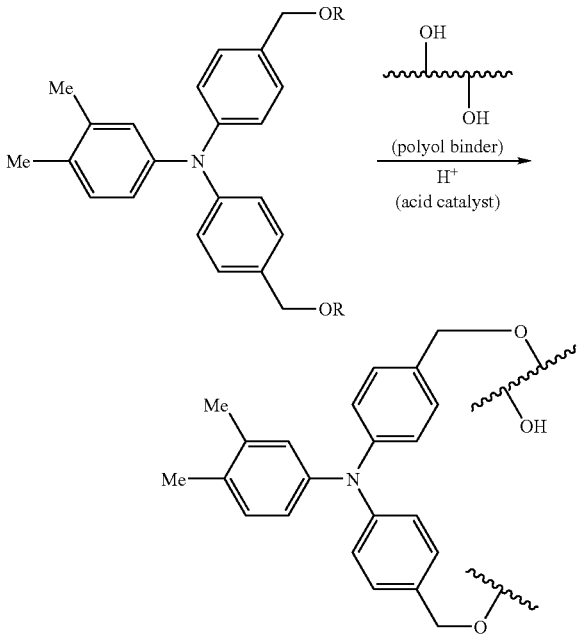

R = H or $C_1$-$C_6$ alkyl chain

If desired or necessary, a blocking agent can also be included. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as Cycat 4040 available from Cytec Ind.

Any suitable alcohol solvent may be employed for the film forming polymers. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, higher boiling alcohol solvents should be avoided, as they can interfere with the desired cross-linking reaction.

Examples of solvents that can be selected for use as coating solvents for the overcoat layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, 1-butanol, amyl alcohol, 1-methoxy-2-propanol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The resin dispersion may be obtained by known or conventional methods, such as by polycondensing a polycondensable monomer (composition) having a composition comprising (a) a polyvalent acid monomer having no addition-polymerizable unsaturated group and/or a derivative thereof in an amount of 10 to 80 mol % based on all monomers, (b) a polyhydric alcohol monomer having no addition-polymerizable unsaturated group in an amount of 10 to 80 mol % based on all monomers, and (c) a monomer having a carboxyl group and an addition-polymerizable unsaturated group and/or a derivative thereof in an amount of about 0.5 to 20 mol % based on all monomers, to obtain a polyester having an addition-polymerizable unsaturated group at the terminal, and addition-polymerizing the addition-polymerizable unsaturated group of the polyester.

The solvent system can be comprised of individual solvents (e.g., dowanol, IPA, water, or other organic solvents) or mixtures of solvents (dowanol+IPA, etc.).

The thickness of the overcoat layer selected depends upon the abrasiveness of the charging (bias charging roll), cleaning (blade or web), development (brush), transfer (bias transfer roll), and the like in the system employed, and can be continuous and may have a thickness of less than about 50 micrometers, for example from about 0.1 micrometers to about 50 micrometers, for example from about 0.1 micrometers to about 15 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The overcoat layer disclosed herein achieves significantly reduced emissions of free formaldehyde from the overcoat layer without substantially negatively affecting the electrical performance of the imaging member to an unacceptable degree.

The overcoat layer can comprise the same components as the charge transport layer wherein the weight ratio between the charge transporting small molecule and the suitable electrically inactive resin binder is less, such as for example, from about 0/100 to about 60/40, or from about 20/80 to about 40/60.

In embodiments, the overcoat layer is prepared by any suitable technique, such as mixing all of the components together. The overcoat layer coating mixture is then applied to the photoreceptor by any suitable application technique, such as spraying dip coating, roll coating, wire wound rod coating, and the like. The deposited overcoat layer may be dried by any suitable technique, such as oven drying, infrared radiation drying, and the like. The reaction between the hole transport compound comprising two or more hydroxymethyl substituents and the polyol binder to form the crosslinked overcoat layer may occur when drying the deposited overcoat layer.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

Protective Overcoat Layers of photoreceptors can be prepared by any conventional means or any other method obvious to those skilled in the art which would produce the desired overcoat layer.

Example 1

A photoreceptor with no melamine formaldehyde and incorporating the hole transport material (e.g., N,N-bis-(4-hydroxymethylphenyl)-3,4-dimethylphenylamine) was prepared in accordance with the following procedure. An overcoat coating solution is prepared as follow: One part of a hydroxyl-containing polymer, 0.68 part of a charge transport compound, and 0.016 part of an acid catalyst are dissolved in 2.45 parts of 1-methoxy-2-propanol and 2.45 parts of isopropanol as a solvent at room temperature (about 20° C. to about 25° C.). The mixture is filtered through a 0.45 micron filter to form a coating solution. The coating composition is then applied using a 0.125 mil Bird bar applicator onto the charge transport layer of the photoconductor sheet, and cured at 120° C. for 2 minutes. The result is an imaging member having an overcoating layer thickness of about 3 microns.

Comparative Example 1

A comparative photoconductor is prepared by repeating the process of Example 1 except that melamine formaldehyde is present and the hole transport material does not serve as the cross-linking agent.

Production grade photoreceptors were coated with Example 1 and Comparative Example 1 formulations. The amount of total solids was kept constant (25%) in both formulations (table 1). The following table illustrates the amount of each constituent of the Example 1 and Comparative Example 1 formulations.

TABLE 1

| Components | | Comparative Example 1 | Example 1 (No melamine-formaldehyde crosslinking agent) |
|---|---|---|---|
| Binder | Desmophen 800 | 0.75 | 0.75 |
| Co-Binder | Desmophen 1652A | 0.25 | 0.25 |
| HTM | CHM-TPA | 1.07 | 0.68 |
| Curing Agent | Cymel 1130 | 0.6 | 0.0 |
| Catalyst | pTSA | 0.2 | 0.2 |
| Leveling Agent | FX-leveling agent | 0.008 | 0.008 |
| Solvent 1 | Dowanol PM | 3.94 | 2.45 |
| Solvent 2 | Isopropanol | 3.94 | 2.45 |

Electrical Testing:

The xerographic electrical properties of the above prepared photoconductors were determined by known means, such as by charging the surfaces thereof with a corona discharge source until the surface potentials, as measured by a capacitively coupled probe attached to an electrometer, attained an initial value $V_0$ of about −600 volts. After resting for 0.33 second in the dark, the charged members attained a surface potential of $V_{ddp}$, dark development potential. A feedback loop adjusts the output of the corona discharge source to hold the Vddp to 500V. The photoconductive imaging members were then exposed to light from a filtered Xenon lamp with at least a 150 watt bulb, thereby inducing a photodischarge which resulted in a reduction of surface potential to a $V_{bg}$ value, background potential. The wavelength of the incident light was 780 nanometers, and the exposure energy of the incident light varied from 0 to 25 ergs/cm$^2$. By plotting the surface potential against exposure energy, a photodischarge curve was constructed.

Photo induced discharge curve (PIDC) measurements were carried out on devices that include a protective overcoat layer incorporating the formulation of Example 1 and other devices including the conventional overcoat formulation using the control solution of Comparative Example 1. The results can be seen in FIG. 1.

As shown, the PIDCs demonstrate that each formulation exhibits essentially identical electrical characteristics, indicating that eliminating the malamine-formaldehyde crosslinking agent had no substantial effect on device electrical performance.

Figure 2:
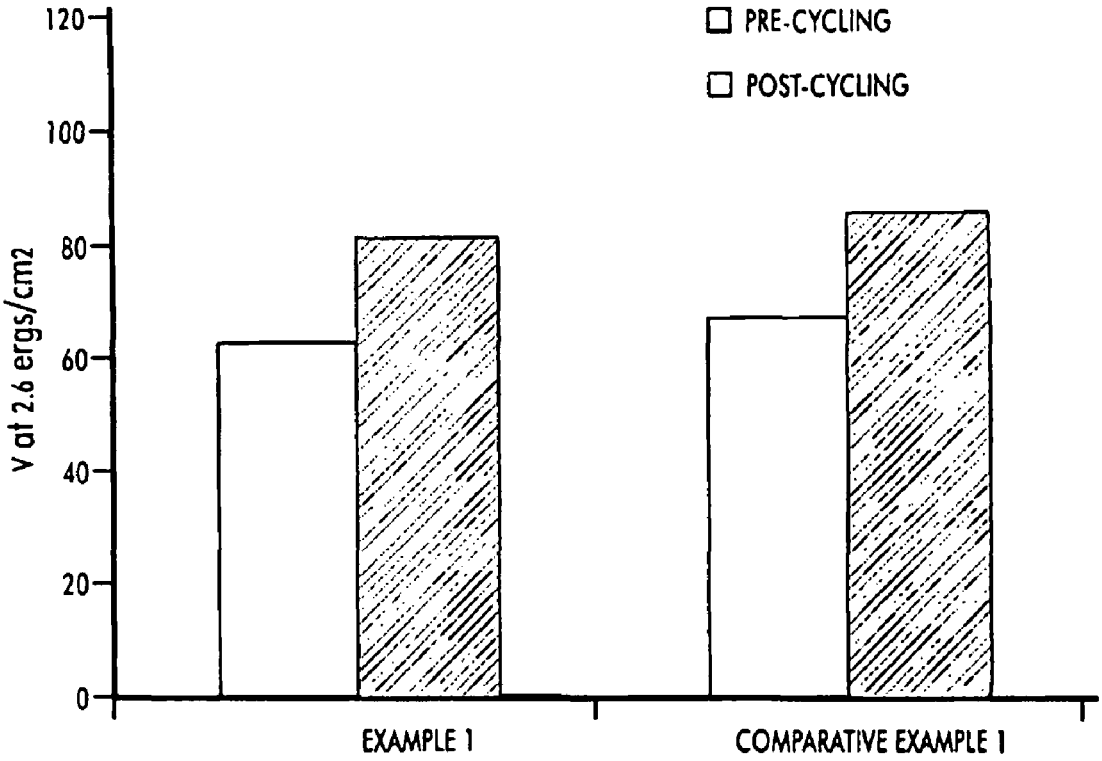
FIG. 2 is a graph showing cycling stability (V at 2.6 ergs/$cm^2$) for photoreceptors of the Examples and Comparative Examples of the disclosure.

Electrical cycling stability measurements were also obtained for devices including a protective overcoat layer incorporating the formulation of Example 1 and other devices including the conventional overcoat formulation using the control solution of Comparative Example 1. The results can be seen in FIG. 2.

Electrical cycling stability tests also reveal that devices with both overcoat layer formulations exhibit the same cycling behavior (as shown from the similar changes in V at 2.6 ergs/cm$^2$ in both devices after cycling for 10,000 cycles).

Mechanical Testing:

Mechanical testing was conducted by mounting sample photoreceptors with Example and comparative protective overcoat layer formulations and performing scratch-testing. Areas of a photoreceptor device that had sections of non overcoated and overcoated areas immediately next to each other were prepared for scratch testing. The samples were suspended and held taunt over a roller made up of three parallel bars at 60 degrees from each other allowing the samples to move vertically when the roller is turned. A Xerox iGen3 cleaning blade was brought into contact with the sample such that when the roller was turned and the sample moved up and down, the blade was rubbed across the sample 10 times to mechanically abrade the surface. The results can be seen in FIG. 3.

Figure 3:
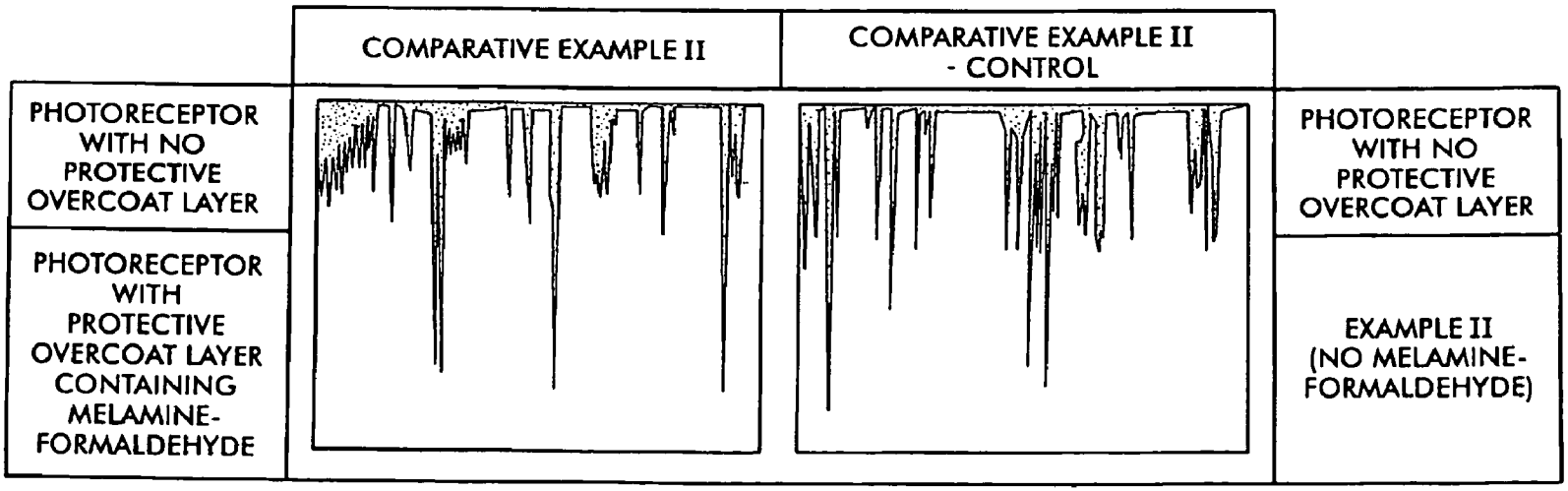
FIG. 3 is a graph showing scratch resistance for photoreceptors of the Examples and Comparative Examples of the disclosure.

In FIG. 3, the sample on the left is a comparison using a conventional photoreceptor wherein the top sample was tested without a protective overcoat layer and the bottom sample was tested using a conventional overcoat layer containing a melamine-formaldehyde crosslinking agent.

The sample on the right is a comparison using a conventional photoreceptor wherein the top sample was tested without a protective overcoat layer and the bottom sample was tested using the formulation of Example 1, containing no melamine-formaldehyde crosslinking agent.

FIG. 3 illustrates that that both protective overcoat samples have superior scratch resistance as compared to comparative examples having no protective overcoat layer. Virtually no reduction in scratch resistance was found between the melamine-formaldehyde crosslinking agent free sample and the conventional formulation that includes a melamine-formaldehyde crosslinking agent.

From the foregoing results, it can be seen that Example 1 without melamine-formaldehyde cross-linking agent has comparable electrical and mechanical performance to comparative formulations containing melamine-formaldehyde. Eliminating the melamine-formaldehyde from the formulation significantly lowers or eliminates the generation of free-formaldehyde, yet does not adversely affect performance.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A curable coating composition comprising:

a polyol binder;

a leveling agent; and a charge transport material;

wherein:

the charge transport material is capable of reacting with the polyol binder and is of the following formula

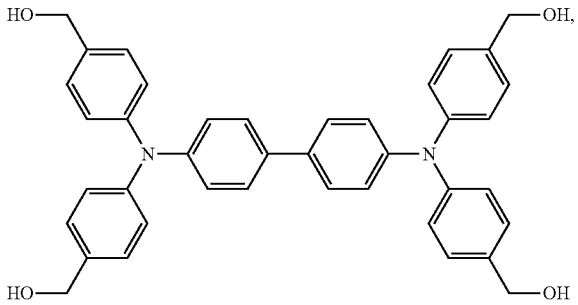

and the coating composition does not contain melamine formaldehyde.

2. The composition of claim 1, further comprising an acid catalyst.

3. The composition of claim 1, wherein the polyol is selected from the group consisting of functionalized polycarbonates, polyesters, and polyacrylates.

4. The composition of claim 1, further comprising at least two ether linkages between the charge transport material and the polyol binder.

5. The composition of claim 1, wherein the polyol is selected from the group consisting of an aliphatic polyester polyol, an aromatic polyester polyol, an acrylated polyol, an aliphatic polyether polyol, an aromatic polyether polyol, a (polystyrene-co-polyacylate) polyol, a polyvinylbutylral, a poly(2-hydroxyethyl methacrylate), and a polycarbonate polyol.

6. The composition of claim 1, wherein the polyol is selected from the group consisting of:

(i) a polyester polyol represented by the formula:

$$[—CH_2—R_a—CH_2]_m—[—CO_2—R_b—CO_2—]_n—[—CH_2—R_c—CH_2]_p—[—CO_2—R_d—CO_2—]_q$$

where $R_a$ and $R_c$ independently represent linear alkyl groups or branched alkyl Groups derived from polyols, $R_b$ and $R_d$ independently represent alkyl groups derived from polycarboxylic acids, and m, n, p, and q represent mole fractions of from 0 to 1, such that n+m+p+q=1, (ii) an acrylated polyol represented by the formula:

$$[R_t—CH_2]_t—[—CH_2—R_a—CH_2]_p—[—CO—R_b—CO—]_n—[—CH_2—R_c—CH_2]_p—[—CO—R_d—CO—]_q$$

where $R_t$ represents $CH_2CR_1CO_2$— where $R_1$ is an alkyl group; t represents mole fractions of acrylated sites from 0 to 1, $R_a$ and $R_c$ independently represent linear alkyl or alkoxy groups or branched alkyl or alkoxy groups derived from polyols; $R_b$ and $R_d$ independently represent alkyl or alkoxy groups; and m, n, p, and q represent mole fractions of from 0 to 1, such that n+m+p+q=1, and (iii) a polyether polyol represented by the formula:

$$—[—CH_2—R_a—CH_2]_m—[—CO—R_b—CO—]_n—[—CH_2—R_c—CH_2]_p—[—CO—R_d—CO—]_q$$

where $R_a$ and $R_c$ independently represent linear alkyl or alkoxy groups or branched alkyl or alkoxy groups derived from polyols; $R_b$ and $R_d$ independently represent alkyl or alkoxy groups; and m, n, p, and q represent mole fractions of from 0 to 1, such that n+m+p+q=1.

7. The composition of claim 1, wherein the charge transport material is present in an amount from about 25 to about 90 percent by weight of the entire coating composition and the polyol is present in an amount of from about 10 to about 75 percent by weight of the entire coating composition.

8. The composition of claim 2, wherein the acid catalyst is an organosulfonic acid or its amine salt derivative.

* * * * *